US006772572B2

(12) United States Patent
Henthorn

(10) Patent No.: US 6,772,572 B2
(45) Date of Patent: Aug. 10, 2004

(54) FABRICATED OSB STUD

(75) Inventor: John R. Henthorn, Beloit, WI (US)

(73) Assignee: Riley Beloit Corporation, Beloit, ME (US)

( * ) Notice: Subject to any disclaimer, the term of this patent is extended or adjusted under 35 U.S.C. 154(b) by 0 days.

(21) Appl. No.: 10/142,753

(22) Filed: May 9, 2002

(65) Prior Publication Data

US 2003/0208986 A1 Nov. 13, 2003

(51) Int. Cl.[7] ..... E04C 3/30

(52) U.S. Cl. ..... 52/731.2; 52/730.7; 52/733.2; 52/737.6

(58) Field of Search ..... 52/730.7, 404.3, 52/729.4, 729.2, 733.2, 690, 481.1, 731.5, 732.3, 737.6, 731.2; 156/292

(56) References Cited

U.S. PATENT DOCUMENTS 1,368,594 A * 2/1921 Aatila ..... 52/737.3
2,230,628 A * 2/1941 Shlberg ..... 52/730.7
3,079,649 A * 3/1963 Willatts ..... 52/691
5,074,092 A * 12/1991 Norlander ..... 52/730
5,551,202 A * 9/1996 Terenzoni ..... 52/730.7
5,625,996 A * 5/1997 Bechtel ..... 52/731.2
5,966,894 A * 10/1999 Crump, Jr. ..... 52/729.4
6,271,156 B1 * 8/2001 Gleason et al. ..... 442/413
6,412,249 B1 * 7/2002 Boyer et al. ..... 52/731.9

FOREIGN PATENT DOCUMENTS

CA 2316422 * 8/2000 ..... E04C/3/12

* cited by examiner

*Primary Examiner*—Carl D. Friedman
*Assistant Examiner*—Nahid Amiri
(74) *Attorney, Agent, or Firm*—Jansson, Shupe & Munger, Ltd.

(57) ABSTRACT

A fabricated wooden stud including: (1) a pair of fully-aligned face-members of OSB spaced from one another and each having first and second ends and first and second elongate edges; (2) first and second fully-aligned edge-members of OSB spaced from one another, the first and second edge-members being adhesively affixed between the face-members along the first edges and second edges thereof, respectively; and (3) a pair of end-members adhesively affixed between the face-members at the ends thereof.

22 Claims, 6 Drawing Sheets

FABRICATED OSB STUD

FIELD OF THE INVENTION

The present invention relates generally to building structures and, more specifically, to studs used primarily in constructing the walls of buildings.

BACKGROUND OF THE INVENTION

Wood frame construction is a very common type of building construction technology used today. In the continual quest to reduce the cost of construction and to increase the productivity of the construction labor force, attention is given to reducing the cost of material, reducing the labor required for construction, and increasing the quality of the material used.

One nearly ubiquitous structural element used in wood construction is a piece of lumber called a stud. Studs are the vertical, load-bearing pieces of wood in the interior or exterior walls of a building to which sheathing or panel material is attached to form the wall structures. In addition to their use in wall construction, studs are also used in other parts of the framing process. There is a need to provide a reliable, low-cost supply of high-quality wooden studs for the construction industry.

The traditional stud is made in one piece and cut from tall trees, into 1½ inch by 3½ inch cross-sections (the standard 2×4), or 1½ inch by 5½ inch cross-sections (the standard 2×6), and milled into various lengths—most typically 8 or 9 feet. Such studs are often subject to warping, both bending and twisting.

Among the many factors which contribute to the cost and quality of wooden studs are the following: (1) the cost of the raw material used, affected by the amount and quality of timber available and the demand for timber; (2) the cost of manufacture of the studs; (3) the cost of transportation, which, among other things, is dependent on the weight of the studs; (4) the resistance to warpage of the studs, which reduces waste and increases the quality of the resulting structures; and (5) ease of use of the studs, affected by weight and by the extent of warpage. Thus, the need for a reliable, low-cost supply of high-quality wooden studs can be translated into a need for straight, stable, lightweight studs made from a source of inexpensive raw material.

One source of inexpensive raw material used in the construction industry is oriented strand board (OSB), a dimensionally-stable engineered wood sheet product which utilizes the fiber available from "waste" trees which are too small to produce traditional solid-wood products such as studs. The raw material for OSB itself, therefore, is inexpensive, and the manufacturing process is highly automated, making OSB an excellent, cost-effective source of raw material for fabricated lumber.

OSB has been used in the past as part of fabricated structural members for applications such as trusses, joists, rafters, and girders, i.e., in applications in which it is necessary for a horizontal structural member to carry vertical loads across the horizontal span of the structural member. Such beams, typically in I-beam or box-beam configurations, were structures to which engineered sheet materials could be applied because of the fact that I-beam and box-beam cross-sections are efficient in withstanding the tensile and compressive loads present in such applications, not to mention the fact that timber for long-span structural members is often not readily available.

However, the concept of engineered structures and in particular hollow box structures has not been widely accepted with respect to studs, i.e., 2×4 and 2×6 structures for use as studs in supporting interior and exterior walls. There are several reasons for this. First, it tends to be counterintuitive to make wooden studs hollow since studs are relatively slender. Second, since studs are designed to receive and to secure fasteners such as nails, it is thought that a hollow stud would not secure the appropriate fasteners as readily as solid wood. Third, studs are sized for placement in vertical, upright positions where they carry mainly compressive forces. Thus, box-shaped designs have not typically been associated with wooden studs.

In the past, there have been a number of efforts directed to the manufacture of engineered wooden beams, primarily for horizontal beam applications, with very little effort of practical consequence being applied with respect to the manufacture of studs intended primarily to take compressive loads. In fact, essentially no engineered wooden studs, whether or not made primarily of OSB, are available in normal market channels. Furthermore, the configuration of fabricated beam structures and other structures that may be seen in prior art documents are quite complex, and thus would typically be relatively expensive to manufacture.

There has been a need for a simple, low-cost, stable compressive-load-bearing wooden stud which can be easily manufactured and easily used.

OBJECTS OF THE INVENTION

Accordingly, it is a principal object of the invention to provide a fabricated wooden stud made primarily of OSB, thereby using wood sources not able to be used for solid timber studs.

It is another object of the invention to provide an improved stud which can be produced at a minimum cost.

Another object of this invention is to provide an improved wooden stud having high structural strength without using solid timber.

Another object of this invention is to provide an improved stud that is not subject to the warping that is often typical of traditional construction lumber.

Another object of this invention is to provide a stud that has lower weight, thereby lowering transportation costs and facilitating use on construction sites.

Another object of this invention is to provide a stud having improved insulating properties.

Yet another object of this invention is to provide a fabricated stud which has the ability to receive framing nails and other fasteners used in wooden building construction.

These and other objects of the invention will be apparent from the following descriptions and from the drawings.

SUMMARY OF THE INVENTION

The instant invention is a fabricated wooden stud which overcomes the above-noted problems and shortcomings and satisfies the objects of the invention. In describing the invention, certain terminology is used which is defined at the end of this summary section.

The fabricated wooden stud of this invention includes: (1) a pair of fully-aligned face-members of OSB spaced from one another and each having first and second ends and first and second elongate edges; (2) first and second fully-aligned edge-members of OSB spaced from one another, the first and second edge-members being adhesively affixed between the face-members along the first edges and second edges thereof, respectively; and (3) a pair of end-members adhesively affixed between the face-members at the ends thereof.

In certain embodiments of the invention, the OSB planes of the face-members and the edge-members are substantially parallel. In another embodiment of the invention, the end-members are OSB, such that the entire stud is made of OSB. In a preferred embodiment of the invention, the OSB planes of the face-members, the edge-members and the end-members are substantially parallel. Manufacturing studs with OSB members the OSB planes of which are parallel greatly simplifies the manufacturing process while producing studs having substantial compressive strength.

In a particularly preferred embodiment of the invention, each of the face-members of the stud has a width equal to the width of the stud. It is also highly preferred that each of the edge-members of the stud has an elongate outer surface, the edge-members being positioned such that the outer surfaces of the first and second edge-members are substantially coplanar with the first edges and second edges, respectively, of the face-members. Another preferred characteristic of the inventive fabricated wooden stud involves the end-members having end surfaces and the end surfaces being substantially flush with the first and second ends of the stud.

In a preferred embodiment of the invention, the stud further includes at least one core-member adhesively affixed between the face-members and dividing the void which is formed by the spaced face-members and the spaced edge-members. Each core-member preferably extends from the first edge-member to the second edge-member.

In certain preferred embodiments of the invention, the end-members and the core-members are OSB, such that the entire stud is made of OSB, with OSB planes of the face-members, the edge-members, the end-members and the core-member(s) most preferably being substantially parallel.

Many of the highly preferred features are most preferably combined in a stud of this invention. That is, such stud would include all of the following characteristics: (a) the end-members and the core-members being OSB such that the entire stud is made of OSB; (b) the OSB planes of the face-members, the edge-members, the end-members and the core-member(s) are substantially parallel; (c) each of the face-members has a length equal to the length of the stud; (d) each of the face-members has a width equal to the width of the stud; (e) each of the edge-members has an elongate outer surface, the edge-members being positioned such that the outer surfaces of the first and second edge-members are substantially coplanar with the first edges and second edges, respectively, of the face-members; and (f) the end-members have end surfaces and the end surfaces are substantially flush with the first and second ends.

Additional preferred features in the inventive stud include broken corners and wiring pass-throughs. These features and their advantages are discussed below. Still another feature in certain embodiments is the inclusion of insulation material in the void space formed by the spaced face-members and the spaced edge-members.

In addition to many benefits of the invention which are seen by the fact that the invention overcomes certain shortcomings of the prior art, it should be recognized that there are benefits of creating a hollow structure in a stud. These include: (1) less raw material used (both OSB and adhesive); (2) reduced transportation costs; (3) less weight for the builders to carry during construction; and (4) improved R-value (insulating capability) from the dead-air space (or other insulating material which can be added during stud fabrication), thereby enhancing the thermal performance of the resulting walls.

In order to minimize, the cost of a fabricated stud, not only is it desirable to use an inexpensive raw material (OSB), it is desirable that the structure be made using a simple and highly-efficient manufacturing process. A description of a highly preferred method for manufacturing the stud of this invention is included below in the section below entitled "Detailed Description of Preferred Embodiments." Such manufacturing method is the subject of a concurrently filed patent application Ser. No. 10/142,3002 of the same inventor, entitled "Method for Manufacturing Fabricated QSB Studs."

The intended meanings of various terms used in this document are set forth in the paragraphs which follow:

The term "face-member" as used herein refers to each of the two wider elongate pieces which, in preferred embodiments of this invention, form all of the wide sides of the stud. In similar fashion, the term "edge-member" as used herein refers to each of the two narrower pieces which, in preferred embodiments of this invention, form part of the narrow sides of the stud.

The term "fully-aligned" is used herein with respect to the two face-members or with respect to the two edge-members. The term describes two members as being sized and oriented with respect to each other in certain ways, namely: (1) the two members have substantially equal dimensions of length, width, and thickness; (2) the length directions of the two members are substantially parallel; and (3) perpendicular projections of the two members onto a plane that is perpendicular to either the thickness or width directions of the members (but not both) are fully overlapping.

The term "end-member" as used herein refers to the two pieces each of which occupies the space inside the stud at an end thereof, such space being formed between the two face-members and the two edge-members.

The term "core-member" as used herein refers to each piece which is similar to an end-member but which occupies a space inside the stud at a selected location away from the ends of the stud, such spaces being formed by the two face-members and the two edge-members.

The term "OSB plane" as used herein with respect to a particular OSB member, refers to the plane of the top surface of the sheet of OSB from which the particular member has been cut. For example, if several sheets of OSB material are layered one on top of another, their OSB planes are parallel regardless of the width and length directions of the OSB sheets from which they have been cut.

The term "face-sheet" as used herein with respect to a method of manufacture, refers to each of the top and bottom OSB layers of the stud assembly.

The term "edge-strip" as used herein with respect to a method of manufacture, refers to each of the plurality of elongate OSB pieces which are part of the stud assembly and which, when the stud assembly is cut into a plurality of studs, form the edge-members of the studs.

The term "inner sheet" as used herein with respect to a method of manufacture, refers to the sheets of OSB from which edge-strips, end-members, and core-members are cut.

The term "stud assembly" as used herein with respect to a method of manufacture, refers to the three-layer sandwich which includes first and second face-sheets with a plurality of edge-strips, end-members, and core-members arranged in accordance with a plan accommodating the stud configuration and the subsequent cutting of the sandwich into a plurality of studs. (See FIG. 3, referred to below.)

The term "assembly base" as used herein refers to a preferably horizontal work surface on which the face-sheets and the various members to be sandwiched therebetween are laid up during the stud fabrication process.

The words "the entire stud is made of OSB" should be understood to allow the use of adhesive to bond the various parts of the fabricated stud together and also to include the optional use of various coatings on the studs, such as a water-repellant coating over the edges of the OSB material.

The term "broken corners" as used herein with respect to a stud refers to the outer corners along the length of the stud as having been trimmed to have a small radius or slightly beveled character in order to eliminate sharp corners.

The term "wiring pass-throughs" as used herein refers to holes through the smallest dimension of the stud to allow electrical wiring to be installed easily in walls constructed with such fabricated wooden studs. Wiring pass-throughs in a series of studs forming a wall allow rapid wiring on the job site. The term is used herein to refer both to holes in individual members of the stud (during manufacturing) as well as to holes through the finished stud.

BRIEF DESCRIPTION OF THE DRAWINGS

FIG. 2*a* is the face view; FIG. 2*b* is the edge view; and FIG. 2*c* is the end view.

DETAILED DESCRIPTION OF PREFERRED EMBODIMENTS

Figure 1:
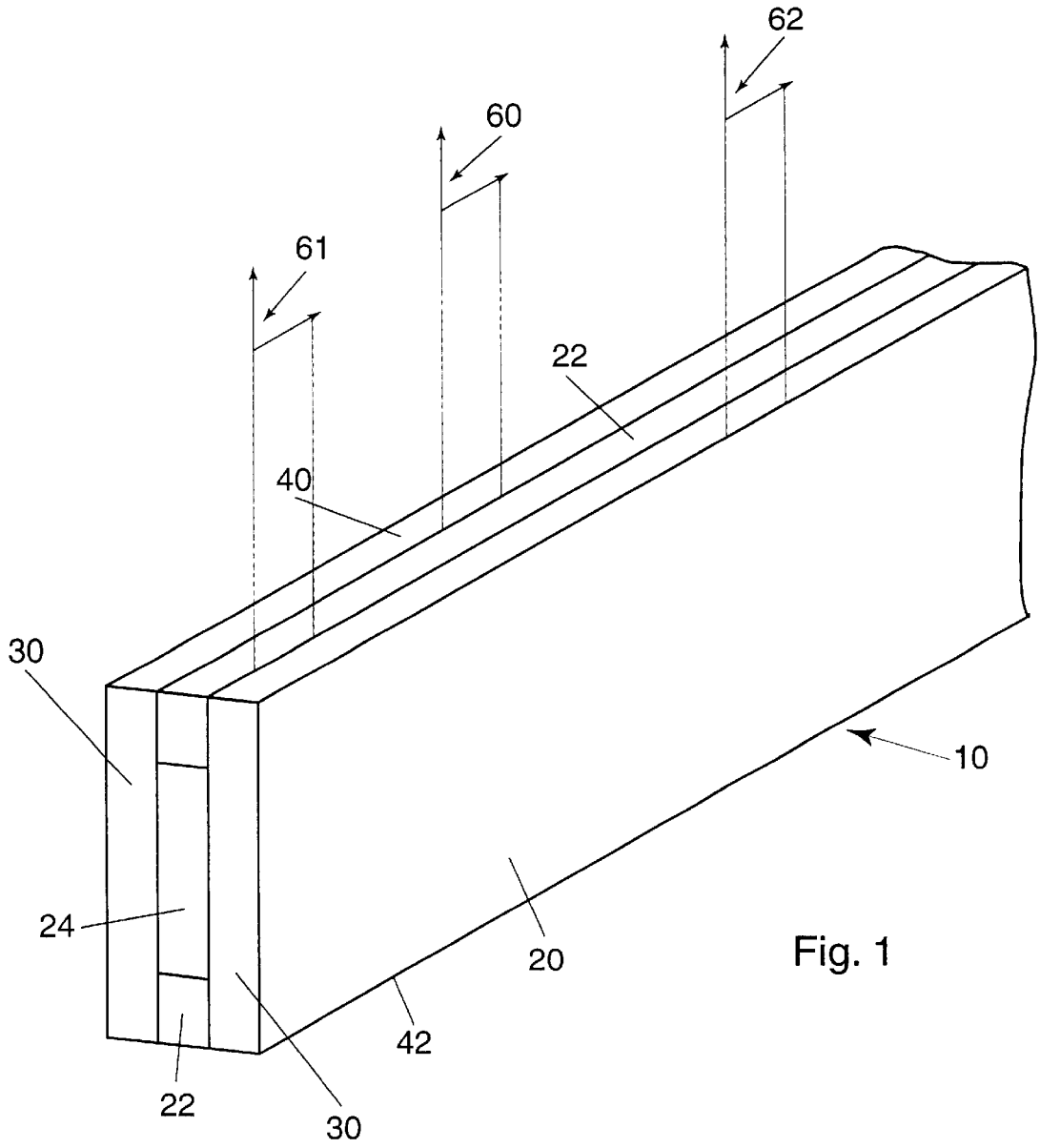
FIG. 1 is a partial perspective drawing of an end portion of the fabricated wooden stud.

FIG. 1 shows a perspective drawing of an end portion of fabricated wooden stud 10, illustrating the general configuration of the stud.

Figure 2C:
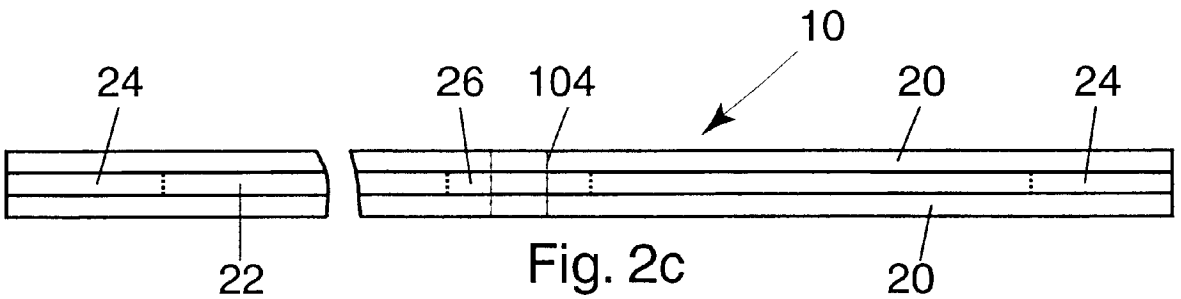
FIGS. 2*a*, 2*b*, and 2*c* are the three orthographic views of the fabricated wooden stud, with the stud broken at a point along the length of the stud in order to show both ends of the stud.
Figure 2B:
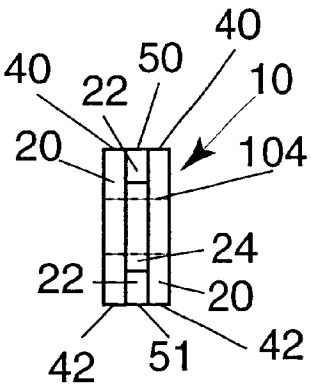
Figure 2A:
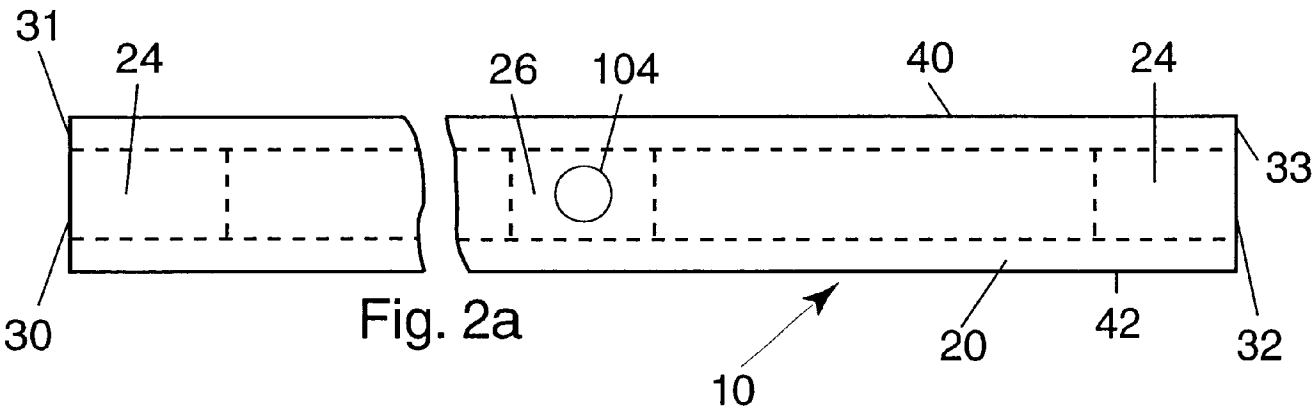

FIGS. 2*a*–2*c*, which are a set of orthographic views of the fabricated wooden stud, illustrate more clearly the complete structure of a highly preferred embodiment of stud 10. Edge-members 22 are sandwiched between and adhesively bonded to two face-members 20. A pair of end-members 24 are also sandwiched between and adhesively bonded to two face-members 20. Face-members 20 are fully-aligned, as are edge-members 22. Edge-members 22 are positioned such that elongate outer surfaces 50 and 51 of edge-members 22 are coplanar with first elongate edges 40 and second elongate edges 42 of face-members 20, respectively. The width of face-members 20 is equal to the full width of stud 10. In addition, end surfaces 30 and 32 of end-members 24 are flush with first end 31 and second end 33 of face-members 20, respectively.

FIGS. 2*a* and 2*c* show one core-member 26 also sandwiched between and adhesively bonded to face-members 20, positioned at a point along the length of stud 10, away from the ends, thereby dividing the void which is formed by the spaced face-members 20 and the spaced edge-members 22.

Referring again to FIG. 1, OSB planes of the various members are indicated by two coordinate axes referenced to the individual members. OSB planes 60 and 62 of face-members 20, OSB plane 61 of edge-members 22, end-members 24, and core-members 26 (not shown in FIG. 1) are all substantially parallel. No OSB planes are illustrated in FIGS. 2*a*–2*c*, but in FIG. 2*a*, OSB planes 60, 61, and 62 would all be parallel to the surface on which the figure is drawn.

Figure 3:
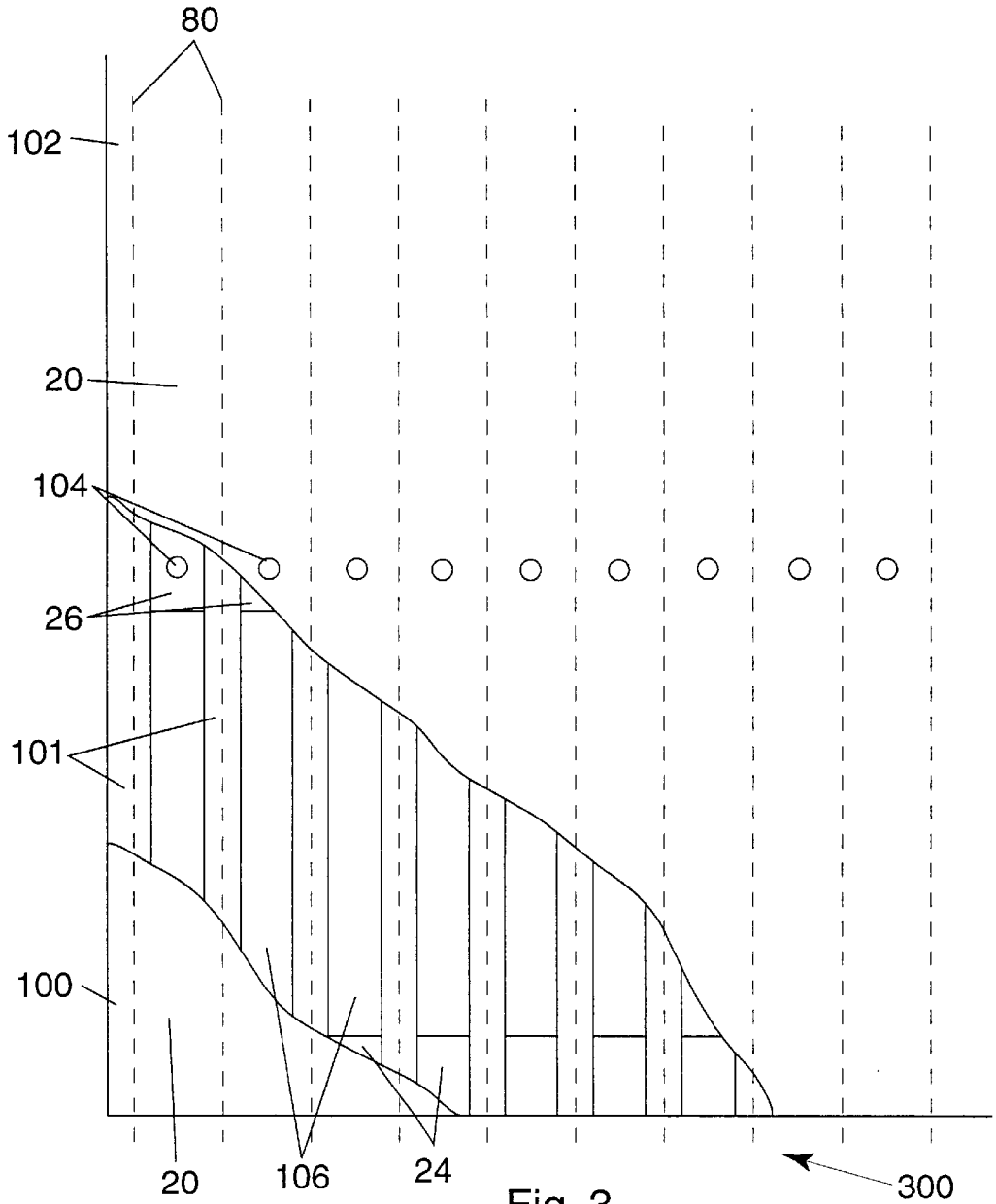
FIG. 3 is a cutaway schematic which illustrates a simple approach to manufacturing the fabricated wooden stud.

Fabricated wooden stud 10 can be manufactured in a simple and cost-effective manner by a batch process. FIG. 3 illustrates such an approach with a cutaway sketch of a three-layer stud assembly 300 of OSB material.

Stud assembly 300, from which studs are cut, is created by arranging edge-strips 101 of OSB (two are labeled but more than two are shown) on OSB face-sheet 100. Spaces 106 (two are labeled but more than two are shown) between edge-strips 101 are the voids formed by spaced edge-strips 101 and spaced face-sheets 100 and 102. End-members 24 (two are labeled but more than two are shown) and core-members 26 (two are labeled and shown) are placed at the ends and in spaces 106 between edge-strips 101 as appropriate. Prior to assembly of stud assembly 300, edge-strips 101, end-members 24, and core-members 26 are cut from one or more inner-sheets in a batch process preparatory to the assembly process. Edge-strips 101, end-members 24, and core-members 26 are all of equal thickness and in a single layer, in a common plane. OSB face-sheet 102 is placed on top of this second layer, becoming the third layer and completing stud assembly 300. The OSB planes of all pieces forming stud assembly 300 are parallel.

During the assembly process, adhesive is applied to all the appropriate surfaces (i.e., at least on adjoining surfaces parallel to the OSB planes) in order to affix together the various members of stud assembly 300. Stud assembly 300 is then pressed together until the adhesive bonding is secure.

Acceptable adhesives include adhesives used in the manufacture of OSB, plywood and other engineered lumber. For example, Mira-Lok—#1077 adhesive manufactured by The Huntsman Polyurethanes is an excellent adhesive for this purpose.

Sawcuts are then made along sawcut lines 80 (two are labeled but more than two are shown) to produce the individual studs. As a result of these sawcuts, portions of edge-strips 101 become edge-members of adjacently-formed studs, and portions of face-sheets 100 and 102 become face-members 20 of adjacently-formed studs.

The size of typical studs for the building industry varies, with 2×4 (1½" by 3½") and 2×6 (1½" by 5½") studs being the most common sizes. The fabricated wooden stud disclosed herein, in standard 8-foot lengths, has a weight which is about 18–20% less than standard studs, using two end-members and a single core-member, each of which are 4 inches long. For further cost savings, the thickness of the stud can be reduced to 1⅜", with the face-members made of 7/16"-thick OSB and the edge-members, end-members, and core-members made of ½"-thick OSB. These typical dimensions are not intended to limit the possible dimensions for the fabricated wooden stud disclosed herein.

Figure 4A:
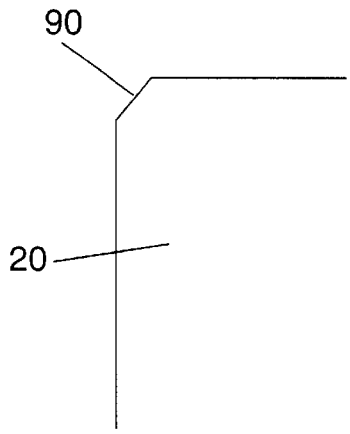
FIGS. 4*a* and 4*b* are partial end-view schematics of one corner of the fabricated wooden stud.
Figure 4B:
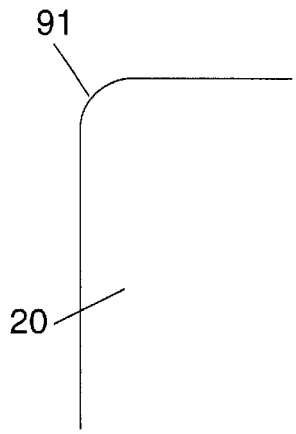

In a highly preferred embodiment of the fabricated wooden stud, the corners of the elongated edges may be broken corners to enhance the safe handling of the stud during use. FIGS. 4*a* and 4*b*, both partial end-view schematics of a fabricated wooden stud, illustrate two embodiments of broken corners. FIG. 4*a* shows beveled corner 90, and FIG. 4*b* shows corner 91 cut with a radius.

Further, the exposed edges of OSB can be coated with a water-resistant coating to protect the OSB prior to installation of the studs into a building structure.

Figure 5:
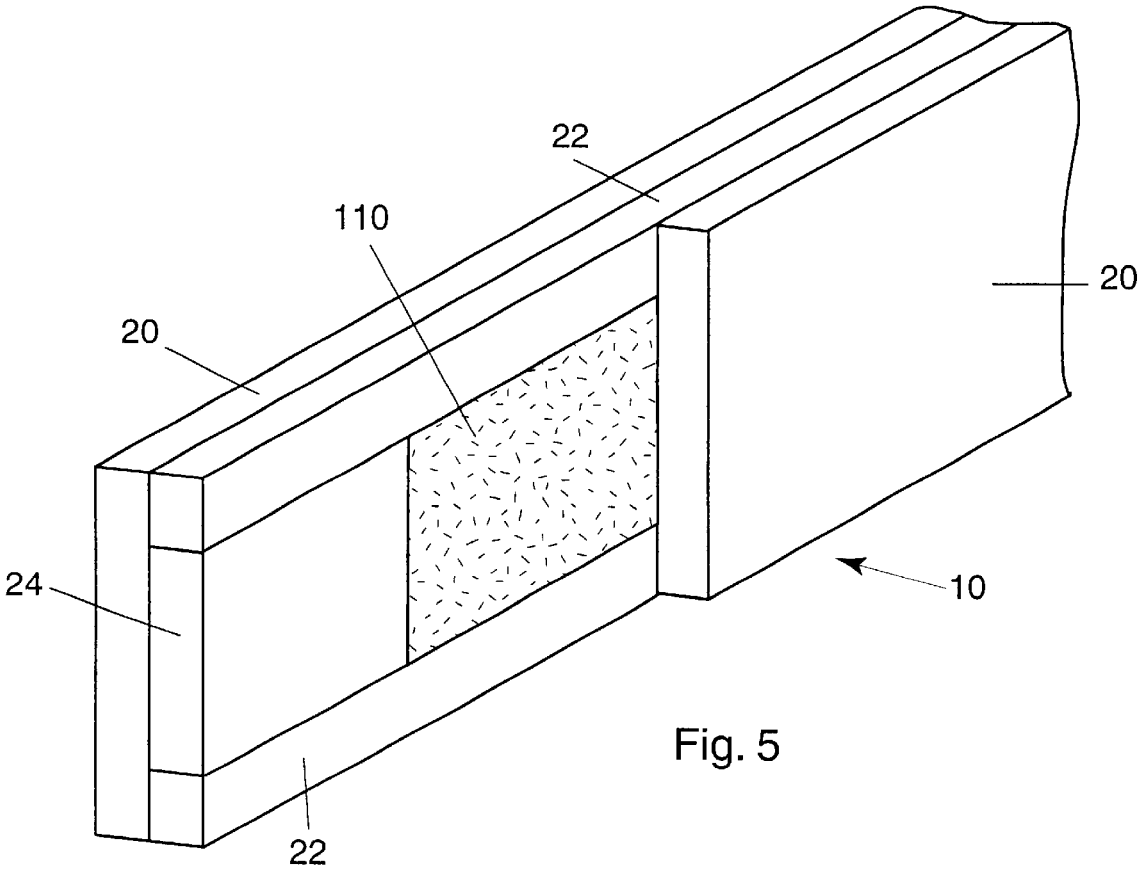
FIG. 5 is a partial cutaway perspective drawing of an end portion of an embodiment of the fabricated wooden stud which includes insulation in the void space which is formed by the spaced face-members and the spaced edge-members.

Voids 106 which are formed in the interior of the studs, in a common embodiment, are filled with air, forming dead-air spaces which have excellent insulating characteristics. In other embodiments of the inventive stud, voids 106 are filled with other insulating materials which have even better insulating properties than dead air. Such materials include various polymer foams and fiber materials such as fiberglass. FIG. 5 is a partial cutaway perspective drawing of an end portion of an embodiment of fabricated wooden stud 10 which includes insulation 110 in void 106 which is formed by spaced face-members 20 and spaced edge-members 22.

A number of variations in the exact form of the fabricated wooden stud are possible, although these are not shown in the figures. For example, the elongate outer surfaces of the edge-members can be inset from the elongate edges of the face-members. In a similar fashion, the end surfaces of the end-members can be inset from the ends of the stud. There may also be situations in which it is desirable to fabricate a wooden stud in which the OSB planes of the edge-members are not substantially parallel to the OSB planes of the face-members.

Another embodiment of the fabricated wooden stud may include end-members and/or core-members which are not made of OSB but of solid wood or another form of fabricated board such as plywood, particle board or medium density fiberboard (MDF).

Another embodiment of the fabricated wooden stud may incorporate end-members in which the end surfaces of the end members extend beyond the ends of the face-members.

While the elements of this invention have been described in connection with specific embodiments, it should be understood clearly that these descriptions are made only by way of example and are not intended to limit the scope of the invention.

Figure 6A:
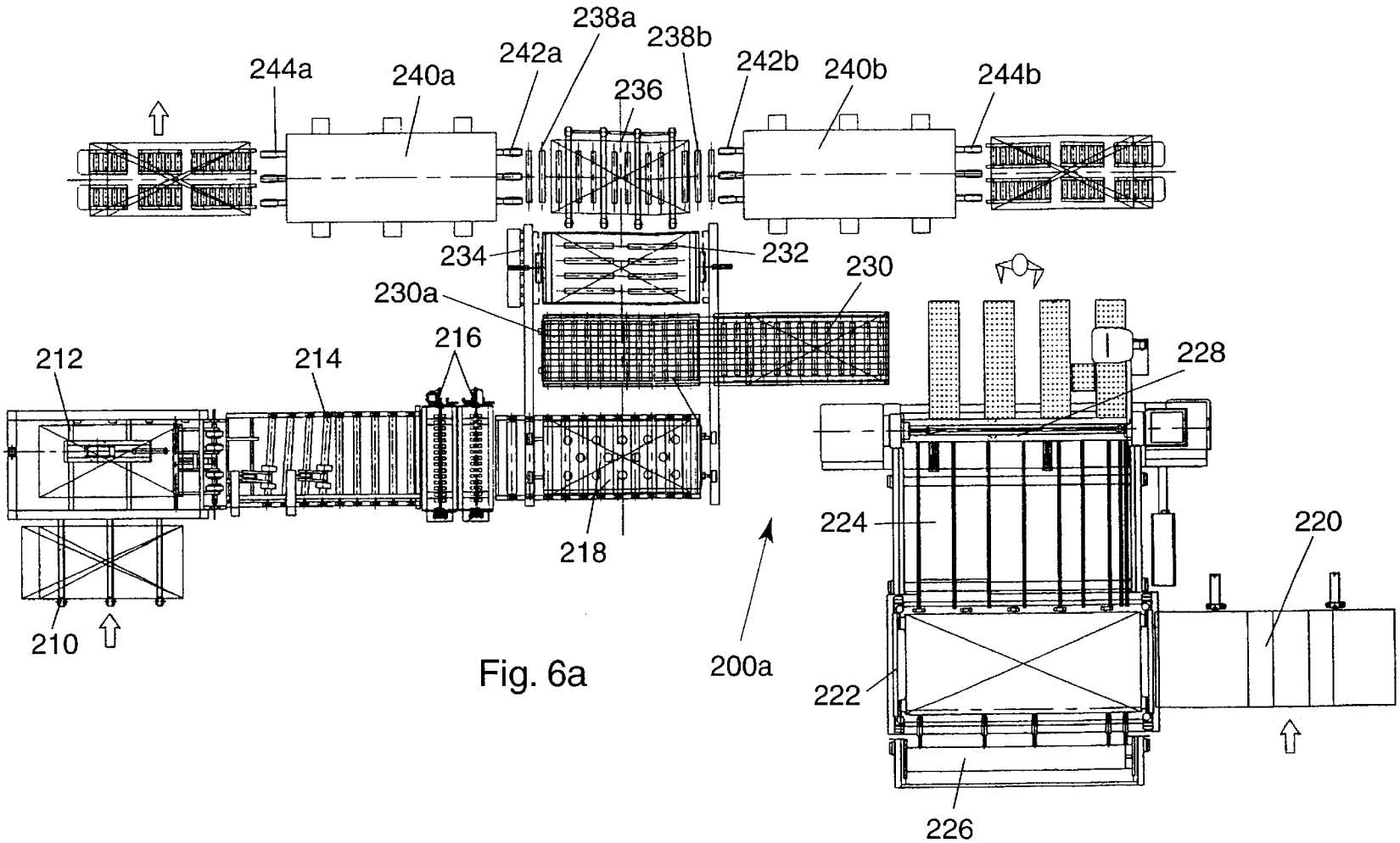
FIGS. 6*a* and 6*b* are schematic diagrams of a preferred embodiment of a production line which is used to manufacture a preferred embodiment of the inventive fabricated OSB studs claimed herein.

FIG. 6*a* is a schematic of a preferred embodiment of a portion of a production line 200*a* configured to manufacture a preferred embodiment of the inventive fabricated wooden stud. The method of manufacture is carried out in a batch process, whereby segments 200*a* and 200*b* of a production line 200 are used for more than one step of the inventive method, as described in the following paragraphs.

The first part of the batch process includes providing a supply of edge-strips 101, end-members 24, and core-members 26 shown in FIG. 3. Referring to FIG. 6*a*, inner sheets are placed on a feeder infeed 210 which supplies inner sheets one at a time to a feeder 212. Feeder 212 feeds inner sheets onto an alignment conveyor 214 which then moves the inner sheets through knockout machines 216 which cut wiring pass-throughs at the locations on the inner sheets which will later be cut into core-members. (Two knockout machines 216 are shown, representing the option that more than one pattern of wiring pass-throughs may be cut with this arrangement of equipment in production line 200.) Inner sheets are then stacked on a feeder 218 and moved by a forklift to an infeed table 220. A plurality of inner sheets are moved onto a platform 222 and pushed onto a saw platform 224 by a pusher 226. Pusher 226 incrementally indexes the plurality of inner sheets to various positions on platform 224, enabling a saw 228 to cut edge-strips 101, end-members 24, and core-members 26 from the plurality of inner sheets. Edge-strips 101, end-members 24, and core-members 26 are stacked (manually in this embodiment) in infeed magazines 230, ready to be placed in stud assemblies during the next portion of the batch process.

Feeder 218, using vacuum to hold sheet material, collects in sequence first face-sheet 100, arranged edge-strips 101, end-members 24, and core-members 26 (arranged as shown in FIG. 3), and second face-sheet 102 and places them on lay-up lift 232. Lay-up lift 232 provides an assembly base for initial lay-up of stud assemblies (defined above). Edge-strips 101, end-members 24, and core-members 26 are collected from magazines (not shown) movably supported on a magazine conveyor 230. The magazines are positioned in line with the movement of feeder 218 on a magazine conveyor 230*a*. As first face-sheet 100, arranged edge-strips 101, end-members 24, and core-members 26, and second face-sheets 102 are stacked onto a lay-up lift 232, an adhesive dispenser 234 moves over and dispenses adhesive onto the upper surface of first face-sheet 100 onto which edge-strips 101, end-members 24, and core-members 26 are placed and then dispenses adhesive onto edge-strips 101, end-members 24, and core-members 26, onto which second face-sheet 102 is placed. This three-layer assembly is repeated on lay-up lift 232 until ten three-layer assemblies are stacked together on lay-up lift 232. Lay-up lift 232, itself or with one or more three-layer assemblies on it, provides what is referred to herein as the assembly base.

When ten three-layer assemblies are stacked on lay-up lift 232, a transfer unit 236 moves the stack onto rollers 238 which are arranged in line with presses 240*a* and 240*b*. Transfer units 242*a* and 242*b* move the stack of three-layer assemblies into presses 240*a* or 240*b* respectively, depending on which press is available for use. The press cycle time, during which pressure is applied to the stack, is twice the length of time it takes to assemble the stack of ten three-layer assemblies. After pressing is complete, outfeed rollers 244*a* and 244*b* are used to transfer stacks out of presses 240*a* and 240*b* respectively. Stacks of three-layer assemblies, now referred to as stud assemblies, are removed from outfeed rollers 244*a* and 244*b* by a forklift truck.

Figure 6B:
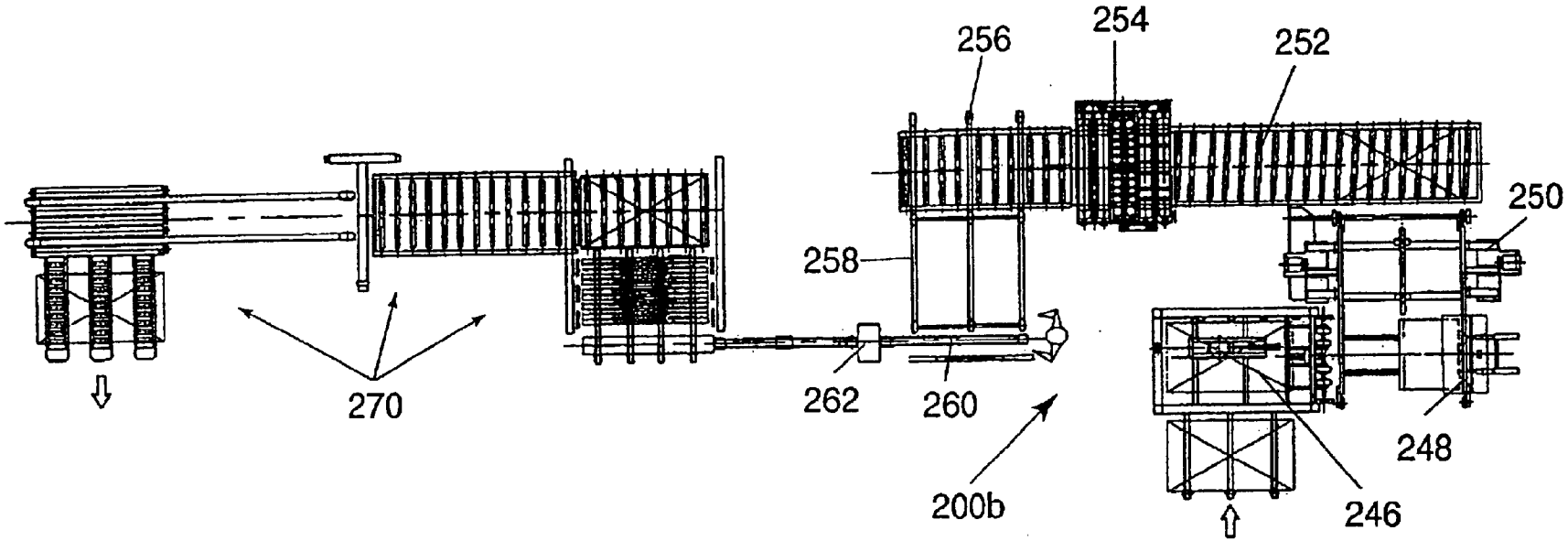

FIG. 6*b* is a schematic of a preferred embodiment of an additional portion of a production line 200*b* configured to perform the method of this invention. Referring to FIG. 6*b*, after a stack of three-layer assemblies is taken from outfeed rollers 244*a* or 244*b* (shown in FIG. 6*a*), the stack is fed into a feeder 246. Feeder 246 feeds stud assemblies one at a time into a corner transfer unit 248 which aligns the stud assembly with a trim saw 250. Trim saw 250 trims a minimal amount of material from each end of the stud assembly. The trimmed stud assembly is moved onto a rip infeed conveyor 252 which aligns the trimmed stud assembly against a side alignment fence (not shown) and moves the trimmed stud assembly into a rip saw 254. Rip saw 254 cuts the trimmed stud assembly into multiple studs of final stud width.

After the studs are ripped from the trimmed stud assembly, and before the studs are coated with sealant at a coater 262, it is preferred that the outer corners along the length of the studs be trimmed to have broken corners, i.e., corners having a small radius or slightly beveled character. This can be done for all four corners in a single pass through a device such as a multi-surface sander (not shown).

An outfeed conveyor 256 and a singulation conveyor 258 transfer the individual studs to an coater infeed 260 which in turn drives the individual studs through a coater 262. Coater 262 places a sealant on the two elongate edges of the studs.

Final marking, strapping, and stacking of the studs is done on various pieces of production line conveyance and handling equipment well-known to those skilled in the art of lumber production and labeled as 270 in FIG. 6*b*.

What is claimed is:

1. A fabricated wooden stud comprising:

a pair of fully-aligned elongate stud-forming face-members of OSB spaced from one another and each having first and second ends and first and second elongate edges, each of the face-members having a width equal to the width of the stud;

first and second fully-aligned elongate stud-fanning edge-members of OSB spaced from one another, the first and second edge-members being adhesively affixed between the face-members along the first edges and second edges thereof, respectively, each of the edge-members having an elongate outer surface, the edge-members being positioned such that the outer surfaces thereof are substantially coplanar with the first edges and second edges, respectively, of the face-members;

the OSB planes of the face-members and the OSB planes of the edge-members all being substantially parallel to one another; and a pair of end-members adhesively affixed between the face-members at the ends thereof.

2. The fabricated wooden stud of claim 1 wherein the end-members are OSB, such that the entire stud is made of OSB.

3. The fabricated wooden stud of claim 2 wherein the OSB planes of the end-members are substantially parallel to the QSB planes of the face-members and the OSB planes of the edge-members.

4. The fabricated wooden stud of claim 1 wherein the end-members each have an end surface, the end surface of one end-member being substantially flush with the first ends of the face-members and the end surface of the other end-member being substantially flush with the second ends of the face-members.

5. The fabricated wooden stud of claim 4 wherein the end-members are OSB, such that the entire stud is made of OSB.

6. The fabricated wooden stud of claim 5 wherein each of the elongate stud-forming face-members has a length equal to the length of the stud.

7. The fabricated wooden stud of claim 5 wherein the OSB planes of the end-members are substantially parallel to the OSB planes of the face-members and the OSB planes of the edge-members.

8. The fabricated wooden stud of claim 1 wherein each of the elongate stud-forming face-members has a length equal to the length of the stud.

9. The fabricated wooden stud of claim 8 wherein the end-members are OSB, such that the entire stud is made of OSB.

10. The fabricated wooden stud of claim 9 wherein the OSB planes of the end-members are substantially parallel to the OSB planes of the face-members and the OSB planes of the edge-members.

11. The fabricated wooden stud of claim 1 further including at least one core-member adhesively affixed between the face-members and dividing void space which is formed by the spaced face-members and the spaced edge-members.

12. The fabricated wooden stud of claim 11 wherein each core-member extends from the first edge-member to the second edge-member.

13. The fabricated wooden stud of claim 11 wherein there are a plurality of the core-members.

14. The fabricated wooden stud of claim 11 wherein:

the end-members and the core-members are OSB, such that the entire stud is made of OSB; and the OSB planes of the end-members and the OSB planes of the core-member(s) are substantially parallel to the OSB planes of the face-members and the OSB planes of the edge-members.

15. The fabricated wooden stud of claim 11 wherein the end-members each have an end surface, the end surface of one end-member being substantially flush with the first ends of the face-members and the end surface of the other end-member being substantially flush with the second ends of the face-members.

16. The fabricated wooden stud of claim 15 wherein:

the end-members and the core-members are OSB, such that the entire stud is made of OSB; and the OSB planes of the end-members and the OSB planes of the core-member(s) are substantially parallel to the OSB planes of the face-members and the OSB planes of the edge-members.

17. The fabricated wooden stud of claim 11 wherein each of the elongate stud-forming face-members has a length equal to the length of the stud.

18. The fabricated wooden stud of clam 17 wherein:

the end-members and the core-members are OSB, such that the entire stud is made of OSB; and the OSB planes of the end-members and the OSB planes of the core-member(s) are substantially parallel to the OSB planes of the face-members and the OSB planes of the edge-members.

19. The fabricated wooden stud of claim 1 wherein the stud includes broken corners.

20. The fabricated wooden stud of claim 1 wherein the stud includes at least one wiring pass-through.

21. The fabricated wooden stud of claim 1 wherein the stud includes insulation material in void space which is formed by the spaced face-members and the spaced edge-members.

22. A fabricated wooden stud comprising:

a pair of fully-aligned elongate stud-forming face-members of OSB spaced from one another and each having first and second ends and first and second elongate edges, each of the face-members having a width equal to the width of the stud;

first and second fully-aligned elongate stud-forming edge-members of OSB spaced from one another, the first and second edge-members being adhesively affixed between the face-members along the first edges and second edges thereof, respectively, each of the edge-members having an elongate outer surface, the edge-members being positioned such that the outer surfaces thereof are substantially coplanar with the first edges and second edges, respectively, of the face-members; and the OSB planes of the face-members and the OSB planes of the edge-members all being substantially parallel to one another.

* * * * *